US010508632B1

(12) United States Patent
Constable

(10) Patent No.: US 10,508,632 B1
(45) Date of Patent: Dec. 17, 2019

(54) ENGINE RAIL PRESSURE SYSTEM

(71) Applicant: Stephen M. Constable, Woodbury, TN (US)

(72) Inventor: Stephen M. Constable, Woodbury, TN (US)

( * ) Notice: Subject to any disclaimer, the term of this patent is extended or adjusted under 35 U.S.C. 154(b) by 0 days.

(21) Appl. No.: 16/548,277

(22) Filed: Aug. 22, 2019

(51) Int. Cl.
*F01M 11/02* (2006.01)
*F02M 47/04* (2006.01)
*F02M 59/48* (2006.01)

(52) U.S. Cl.
CPC ..... *F02M 47/046* (2013.01); *F01M 11/02* (2013.01); *F02M 59/48* (2013.01); *F02M 2200/8076* (2013.01); *F02M 2200/90* (2013.01)

(58) Field of Classification Search
CPC ..... F02M 47/046; F02M 59/48; F02M 2200/8076; F02M 2200/90; F01M 11/02
See application file for complete search history.

(56) References Cited

U.S. PATENT DOCUMENTS

| | | | | |
|---|---|---|---|---|
| 125,764 | A | 4/1872 | Spiegle | |
| 282,006 | A | 7/1883 | Morgan | |
| 624,624 | A | 5/1899 | Casey | |
| 2,392,030 | A | 1/1946 | Davis | |
| 2,729,306 | A | 1/1956 | Davis | |
| 4,852,534 | A | 8/1989 | Amaral | |
| 5,423,296 | A * | 6/1995 | Barr | F01M 1/16 123/196 S |
| 5,517,972 | A | 5/1996 | Stockner | |
| 7,876,562 | B2 | 1/2011 | Visser | |
| 2005/0061289 | A1 | 3/2005 | Plenzler et al. | |

* cited by examiner

*Primary Examiner* — Ryan J. Walters
(74) *Attorney, Agent, or Firm* — Shane Cortesi

(57) ABSTRACT

Rods for increasing pressure within an oil reservoir of an engine are described. In some embodiments, the rod includes a front end with a front flange and a rear end with a rear flange to assist with centering the rod within the oil cavity. The rod may be comprised of a front section that removably attaches to a rear section via a connector screw and the connector screw may be long enough to prevent the connector screw from backing out when the rod is in the oil cavity. Methods of using and installing the rod are also described.

22 Claims, 4 Drawing Sheets

ENGINE RAIL PRESSURE SYSTEM

BACKGROUND

Technical Field

The present application relates to vehicle en more particularly to devices and methods for casing pressure within an oil reservoir of a vehicle engine.

Background of the Invention

The FORD 7.3 liter POWERSTROKE engine, which is the same as the INTERNATIONAL MOTORS T444E engine, were popular diesel truck engines produced by Caterpillar Inc. (Deerfield, Ill.). The engines are characterized by their hydraulic, electric unit injection system which uses highly pressurized engine oil as a medium for generating fuel pressure directly into the injector body that improves overall performance, lower emissions, and better fuel economy.

As known to those of ordinary skill and depicted in FIG. 1, such diesel engines 8 include oil pressure sensors 12, a high-pressure oil pump 14, cylinder heads 16, high-pressure oil feed hoses 18 that feed oil through entrance ports 20 into oil rails 22 (such oil cavities are also referred to in the art as "high-pressure oil rails" and "common rail passages"), injector oil feed galleries 24 (also referred to herein as "exit ports"), fuel injectors 26, an oil pressure regulator 28, an engine front cover 30 and a high-pressure oil pump reservoir 32. During initial start or cold start, the high-pressure oil pump 14 receives unfiltered oil from a valve lifter oil gallery through an anti-drain back check ball valve. Once the engine 8 starts or during warm engine starts, the check ball closes and the high-pressure oil pump 14 receives filtered oil from the high-pressure oil pump reservoir 32. The high-pressure oil pump 14 pumps the oil under extremely high pressures 4,115-20,577 kPa (600-3,000 psi) through the passenger and driver-side high-pressure oil feed hoses 18 through the entrance ports 20 into the oil rails 22 (integral to the cylinder heads 16). Once in the oil rail 22, the oil is fed to the fuel injector 26 bores through the injector oil feed galleries 24 drilled and machined in the cylinder head 16. The high-pressure oil then actuates the fuel injectors 26. Fluid flow in FIG. 1 is indicated with the directional arrows. It will be appreciated that not all parts are shown in FIG. 1 since such engine is known to those of ordinary skill. Such engines also are partially described in U.S. Pat. No. 5,517,972, the entire contents of which are incorporated herein by reference, where the oil rails are denoted by the numerals 398 and 400.

A common problem for such engines is that the pressure into the fuel injectors is less than desirable for high performance. Past attempts to solve this problem include the use of stronger pumps, higher volume flowing pumps and adding a secondary pump via a mounting block. However, such pumps are costly and require skill to install. Thus, there is a need for new apparatuses and methods for increasing oil pressure that are more economical and are easier to install.

BRIEF SUMMARY

In some embodiments, the present disclosure provides apparatuses and methods for increasing oil pressure within an oil cavity.

In some embodiments, the present disclosure provides a method of increasing oil pressure within an oil rail of an engine comprising the steps of: a) providing an engine that may include a pump, a plurality of fuel injectors, and an oil rail. The oil rail may include i) an oil rail front end, ii) a front plug located adjacent to the oil rail front end and having a front plug front end and a front plug rear end, iii) an oil rail rear end; iv) a rear plug adjacent to the oil rail rear end and having a rear plug front end and a rear plug rear end; v) an oil rail length extending from the oil rail front end to the oil rail rear end; vi) one or more oil rail entrance ports located between the front plug rear end and the rear plug front end; and/or vii) one or more oil rail exit ports located between the front plug rear end and the rear plug front end. The pump may be configured to pump oil through the one or more oil rail entrance ports into the oil rail and preferably out of the oil rail via the oil rail exit ports and into the fuel injections. Optionally, the method further includes b) providing a rod comprising a rod front end, a rod rear end, and a rod length extending from the rod front end to the rod rear end. Optionally, the method further includes c) removing at least one of the front plug and the rear plug. Optionally, the method further includes d) positioning the rod in the oil rail so that the rod is located between the oil rail rear end and the oil rail front end and the rod length is generally parallel to the oil rail length. Optionally, the method further includes e) adding at least one plug (e.g., the same or a different front and/or rear plug) to the oil rail to replace the at least one plug removed in step c) so that after step e), the rod is located between the rear plug front end and the front plug rear end. Optionally, step c) comprises removing the front plug from the oil rail, step d) comprises inserting the rod through the oil rail front end and into the oil rail so that the rod is located forwardly relative to the front end of the rear plug, and step e) comprises adding the same or a different front plug to the oil rail so that, after step e), the rear end of the front plug is located forwardly relative to the rod. Optionally, the rod is generally straight and rigid. Optionally, wherein, after step e), the distance between the rear end of the front plug and the front end of the rear plug is greater than the rod length. Optionally, the rod comprises a maximum rod width generally perpendicular to the rod length and a maximum rod height generally perpendicular to the rod width and rod length, wherein the rod length is at least five times greater than each of the rod maximum height and the rod maximum width. Optionally, after step d), the rod takes up at least 75% of the volume of the oil rail between the front plug rear end and the rear plug front end. Optionally, the rod comprises a front flange adjacent to the rod front end and a rear flange adjacent to the rod rear end. Optionally, the rod is generally cylindrical in shape, and further wherein the front flange and rear flange are generally circular in shape. Optionally, the front flange and rear flange have a diameter of between about 1 inch and about 1.5 inches and the rod, excluding the front and rear flanges, has a diameter of between about 0.5 inches and about 1 inch. Optionally, the rod comprises a rod body located between the front flange and the rear flange, and further wherein the front flange is in the form of a front washer attached to the rod body by a front screw and the rear flange is in the form of a rear washer attached to the rod body by a rear screw. Optionally, after step e), the combined length of the rod and the front screw is between about 19 inches and about 22 inches and the combined length of the rod and the rear screw is between about 19 inches and about 22 inches. Optionally, the rod body diameter is less than each of the maximum height and maximum width of the oil rail. Optionally, after step e), the rod length is between about 16 inches and about 20 inches. Optionally, the rod is configured to withstand temperatures of at least 1,080 degrees Fahrenheit. Optionally, after step e), the rod is moveable longitudinally within the oil rail between the front end of the rear plug and the rear end of the front plug. Optionally, at least after step e), the rod is comprised of a front section comprising a front section front end and a front section rear end and a rear section comprising a rear section front end removably attached to the front section rear end. Optionally, step d) comprises inserting both the front section and the rear section through the oil rail front end. Optionally, step d) comprises inserting the front section front and rear ends and the rear section front end through the oil rail front end with the front section rear end not attached to the rear section front end and then attaching the front section rear end to the rear section front end in the oil rail. Optionally, one of the front section rear end and the rear section front end comprise a connector screw and the other of the front section rear end and the rear section front end comprises a threaded socket configured to receive the connector screw. Optionally, the front section, when unattached to the rear section, comprises a front section length extending from the front section front end to the front section rear end, wherein the rear section, when unattached to the front section, comprises a rear section length extending from the rear section front end to the rear section rear end, and further wherein the combined length of the front section and the rear section when the front section is not attached to the rear section is between about 19 inches and about 22 inches, and further wherein the rod length, when the front section is attached to the rear section is between about 16 inches and about 19 inches. Optionally, the front section comprises a front flange adjacent to the front section front end and the rear section comprises a rear flange adjacent to the rear section rear end. Optionally, except for the connector screw and the socket, the front section and the rear section are substantially the same size and shape. Optionally, in step a) the pump is able to generate a first amount of pressure in the oil rail, wherein, after step e), the pump is able to generate a second amount of pressure in the oil rail, the second amount of pressure greater than the first amount of pressure.

In still further embodiments, the present disclosure provides a method of increasing pressure within a cavity comprising the steps of; a) providing a pressurized cavity-system that may include a pump and a cavity comprising one or more entrance ports and one or more exit ports, the pump configured to pump a fluid through the one or more entrance ports into the cavity (and preferably out of the cavity via the exit ports), the pump configured to generate a first amount of pressure in the cavity; b) providing a rod comprising a rod front end, a rod rear end, and a rod length extending from the rod front end to the rod rear end; and c) positioning the rod in the cavity so that the pump is able to generate a greater amount of pressure in the cavity as compared to step a). In such system, the rod may have one or more features described above or elsewhere herein.

In still further embodiments, the present disclosure provides a rod configured to increase oil pressure in a cavity, the rod comprising a rod front end, a generally circular front flange adjacent to the rod front end, a rod rear end, a generally circular rod rear flange adjacent to the rod rear end, a generally cylindrical rod body between the generally circular front flange and the generally circular rear flange, and a rod length extending from the rod front end to the rod rear end. Optionally, the rod is configured to withstand temperatures of at least 1,080 degrees Fahrenheit. Optionally, the rod is comprised of a front section comprising a front section front end and a front section rear end and a rear section comprising a rear section front end removably attached to the front section rear end. Optionally, one of the front section rear end and the rear section front end comprise a connector screw and the other of the front section rear end and the rear section front end comprises a threaded socket configured to receive the connector screw. Optionally, the generally circular front flange and rear flange have a diameter of between about 1 inch to about 1.5 inches and the generally cylindrical rod body has a diameter of about 0.5 inches to about 1 inch. Optionally, the rod length, when the front section is attached to the rear section, is at least about 16 inches. Optionally, the front section, when unattached to the rear section, comprises a front section length extending from the front section front end to the front section rear end, wherein the rear section, when unattached to the front section, comprises a rear section length extending from the rear section front end to the rear section rear end, and further wherein the combined length of the front section and the rear section when the front section is not attached to the rear section is between about 19 inches and about 22 inches, and further wherein the rod length, when the front section is attached to the rear section, is between about 16 inches and about 19 inches. In such system, the rod may have one or more features described above or elsewhere herein.

BRIEF DESCRIPTION OF THE DRAWINGS

in FIG. 1, the passenger-side oil rail, injectors and cylinder-head and associated components are shown above the driver-side oil rail, injectors and cylinder-head and associated components.

DETAILED DESCRIPTION

Figure 1:
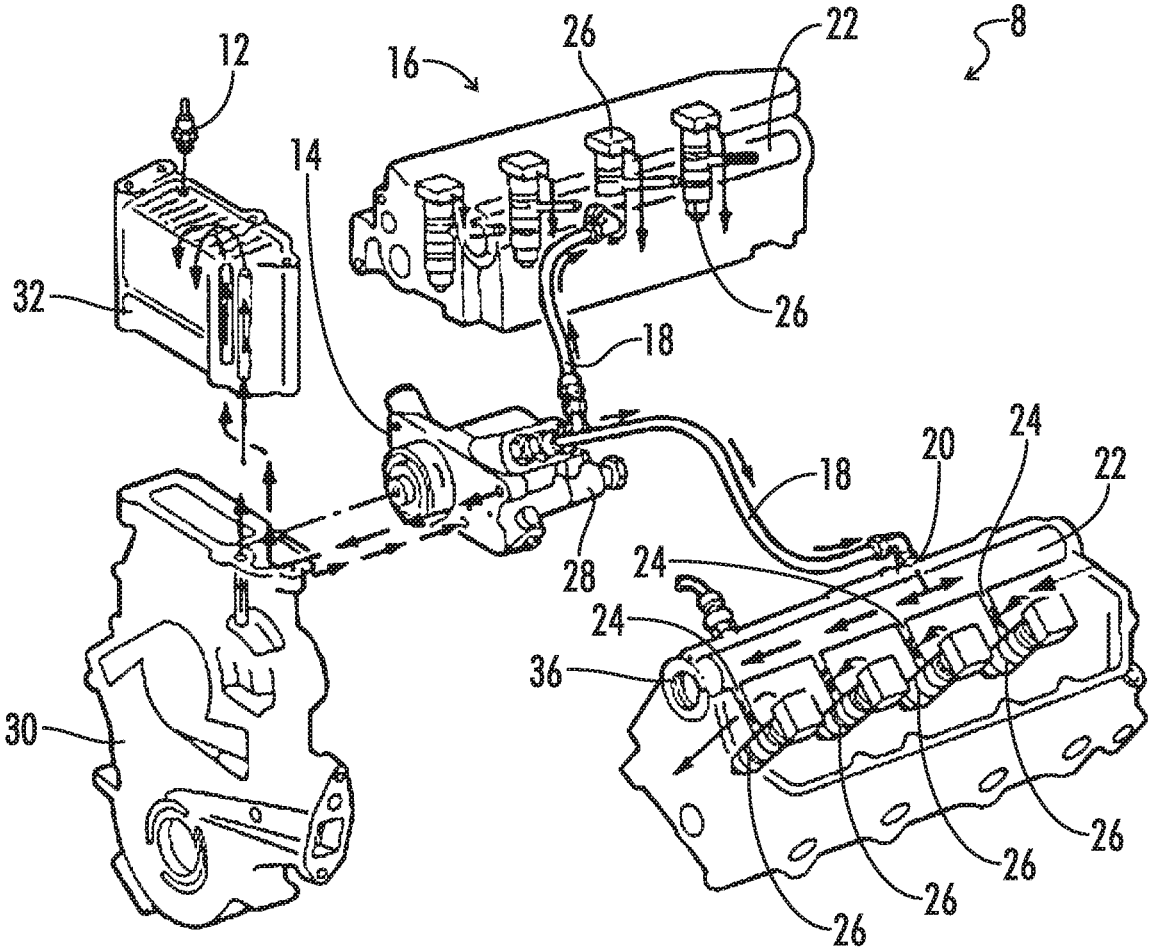
FIG. 1 (PRIOR ART)
FIG. 1 illustrates a schematic view of a prior art for use with the rod of the present invention.

With reference to FIGS. 2-8, in some embodiments, the present invention provides a rod 10 for increasing oil pressure and methods of using same. In the drawings, not all reference numbers are included in each drawing for the sake of clarity. In addition, the size of the rod 10 relative to the oil rail 22 is drawn to scale and the features of the rod 10 of FIGS. 2-8 are drawn to scale, however, other dimensions are possible.

Figure 2:
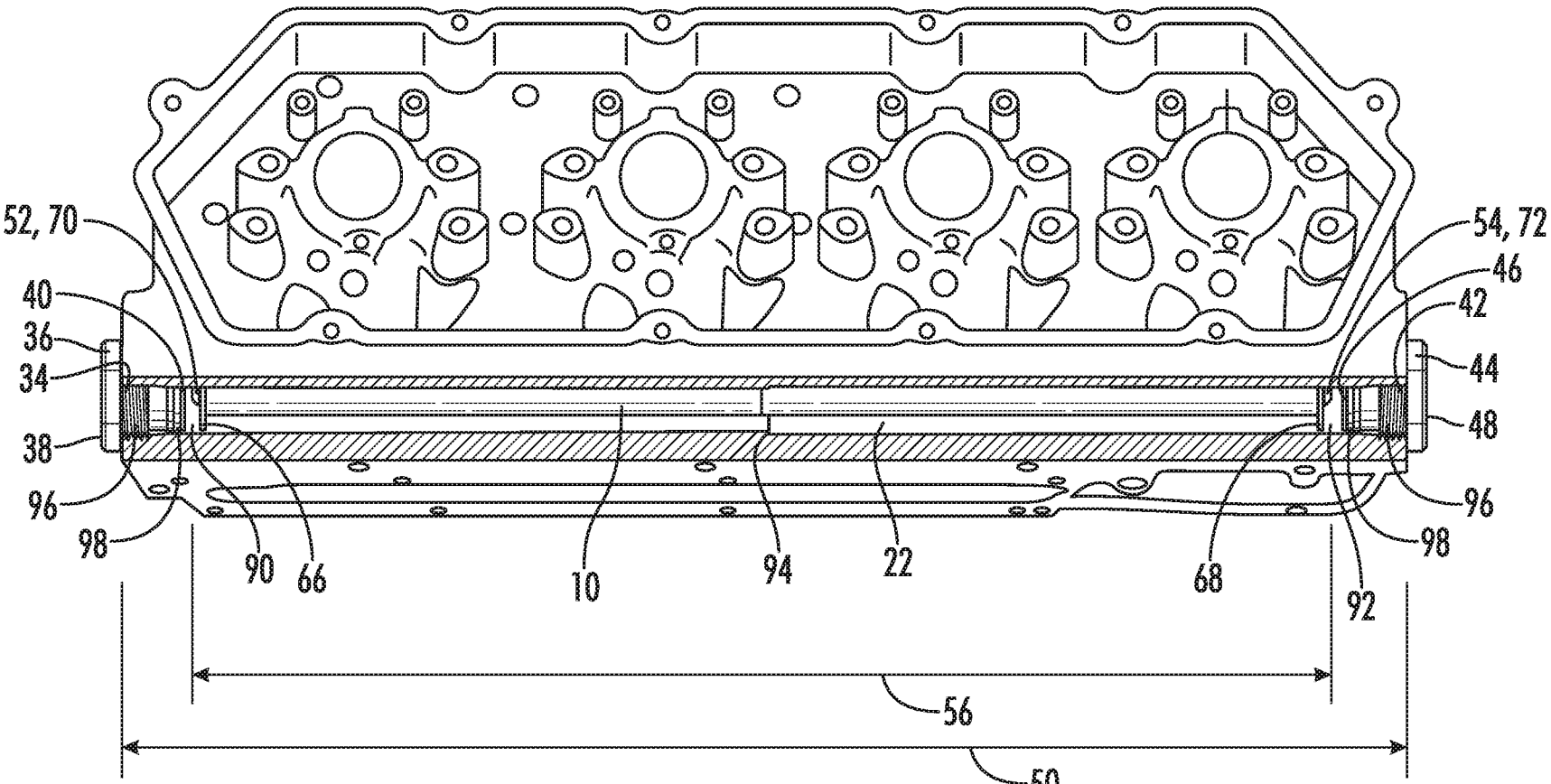
FIG. 2 illustrates a sectional view of a passenger-side portion of the engine of FIG. 1 with a rod of one embodiment of the present invention positioned in the oil rail between the rear end of the front plug and the front end of the rear plug.

Referring further to FIGS. 2-8, in some embodiments, the present disclosure provides a method of increasing oil pressure within an oil rail 22 of an engine 8 using the rod 10. More particularly, the method may include a) providing an engine 8 comprising a pump, a plurality of fuel injectors 26, and an oil rail 22 comprising i) an oil rail front end 34, ii) a front plug 36 located adjacent to the oil rail front end 34 and having a front plug front end 38 and a front plug rear end 40, iii) an oil rail rear end 42; iv) a rear plug 44 adjacent to the oil rail rear end 42 and having a rear plug front end 46 and a rear plug rear end 48; v) an oil rail length 50 extending from the oil rail front end 34 to the oil rail rear end 42; vi) one or more oil rail entrance ports 20 located between the front plug rear end 40 and the rear plug front end 46; and vii) one or more oil rail exit ports 24 located between the front plug rear end 40 and the rear plug front end 46, the pump configured to pump oil through the one or more oil rail entrance ports 20 into the oil rail 22 and preferably out the one or more oil rail exit ports 24 and into the fuel injectors 26. In a preferred embodiment, the engine 8 is the FORD 7.3 liter POWERSTROKE/INTERNATIONAL MOTORS T444E engine described above and illustrated in FIG. 1, however, it will be appreciated that the rod 10 of the present disclosure may be used to increase pressure in any cavity. As known to those of ordinary skill and illustrated in FIG. 1, the front 36 and rear plug 44 may include threads 96 and O-rings 98. The engine may also include two oil rails 22 (a passenger-side and a driver-side). The method may further include the step of removing at least one of the front plug 36 and the rear plug 44. The method may further include the step of providing a rod 10 comprising a rod front end 52, a rod rear end 54, and a rod length 56 extending from the rod front end 52 to the rod rear end 54. The method may further include positioning the rod 10 in the oil rail and replacing the removed plug 36 and/or 44 (with the same front and/or rear plug 36 and/or 44 or a different front and/or rear plug 36 and/or 44) so that the rod 10 is located between the front plug rear end 40 and the rear plug front end 46 and so that the rod length 56 is generally parallel to the oil rail length 50, as shown in FIG. 2. (It will be appreciated that FIG. 2 shows the passenger-side oil rail 22 of FIG. 1). Optionally, the front plug 36 and rear plug 44 create a seal.

As known in the art, typically access to the rear plug 44 of the FORD 7.3 liter POWERSTROKE/INTERNATIONAL MOTORS T444E engine 8 is blocked by the firewall of the vehicle body. Thus, preferably only the front plug 36 is removed from the oil rail 22, the rod 10 is inserted through the oil rail front end 34 and into the oil rail 22 so that the rod 10 is located forwardly relative to the front end 46 of the rear plug 44, and the same or a different front plug 36 is attached to the oil rail 22 so that the rear end 40 of the front plug 36 is located forwardly relative to the rod 10.

Optionally, the rod 10 is generally straight (as shown in FIGS. 2, 3, 6 and 8) and rigid. Optionally, given the temperatures in the oil rail 22, the rod 10 is configured to withstand temperatures of at least 1,080 degrees Fahrenheit. In a preferred embodiment, the rod 10 is metallic. For example, the rod 10 may be comprised of 6016-T6 aluminum or any other suitable material.

Optionally, as shown in FIGS. 2-8, the rod 10 comprises at least one flange to center the rod 10 in the oil rail 22. For example, optionally, as shown in FIGS. 2-8, the rod 10 comprises a front flange 66 adjacent to the rod front end 52 and a rod rear flange 68 adjacent to the rod rear end 54. Without being bound by any particular theory, the front and rear flanges 66, 68 may serve to center the rod 10 in the center of the height and width of the oil rail 22. Optionally, the rod 10 is generally cylindrical in shape, and the front flange 66 and rear flange 68 are generally circular in shape. Optionally, the front flange 66 and rear flange 68 have a diameter of between about 1 inch and about 1.5 inches, more preferably about 1.25 inches. Optionally, the rod body 100 (which is located between the front and rear flanges 66, 68) has a diameter of between about 0.5 inches and about 1 inch, more preferably about 0.75 inches.

Figure 3:
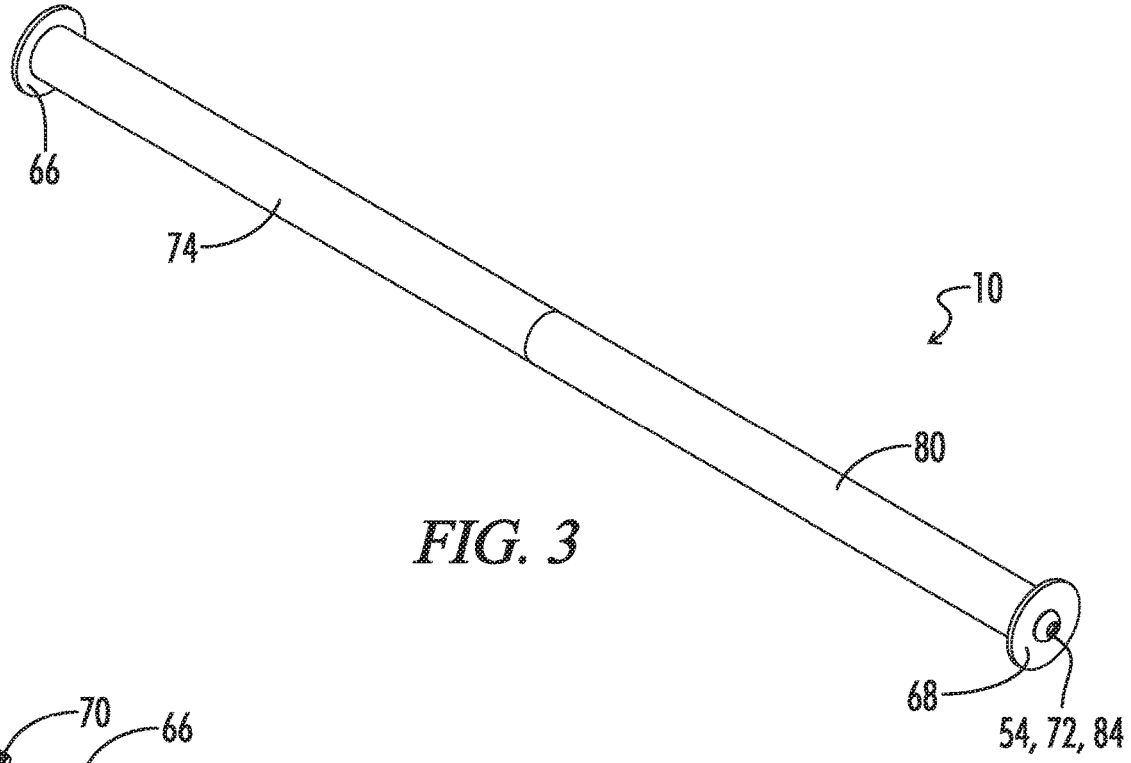
FIG. 3 illustrates a side perspective view of the rod of FIG. 2.
Figure 4:
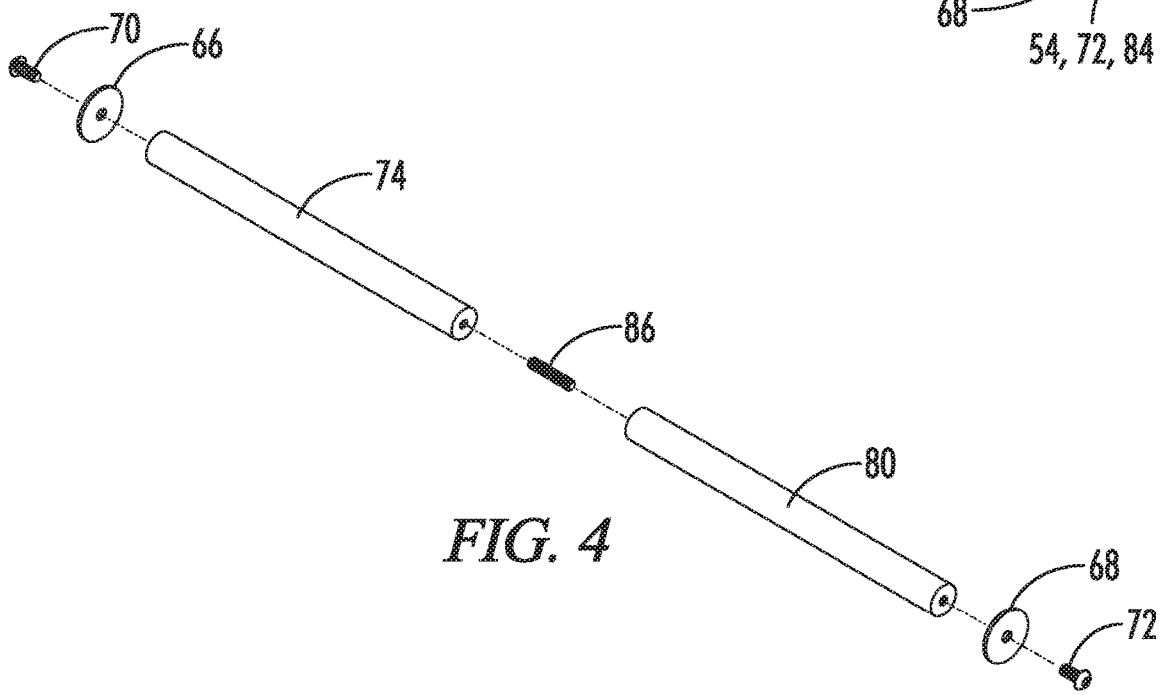
FIG. 4 illustrates a side perspective exploded view of the rod of FIG. 2.
Figure 5:
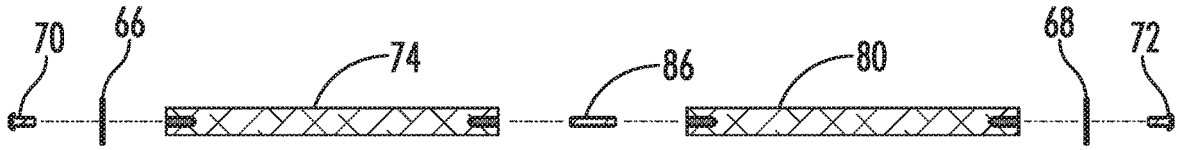
FIG. 5 illustrates a side sectional view of the rod of FIG. 2.
Figure 6:
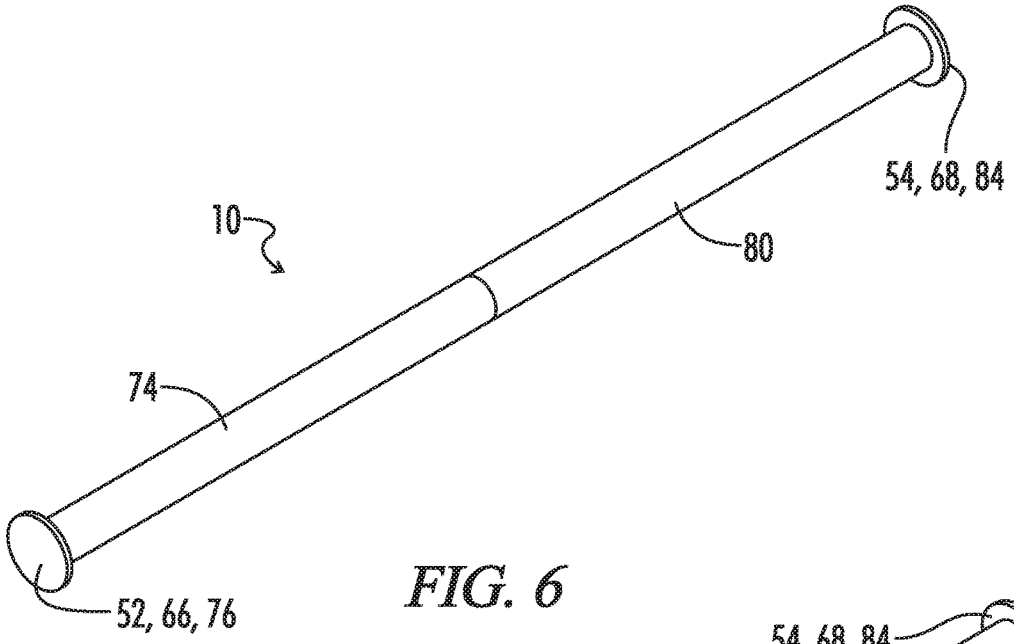
FIG. 6 illustrates a side perspective view of a rod of another embodiment of the present invention.
Figure 7:
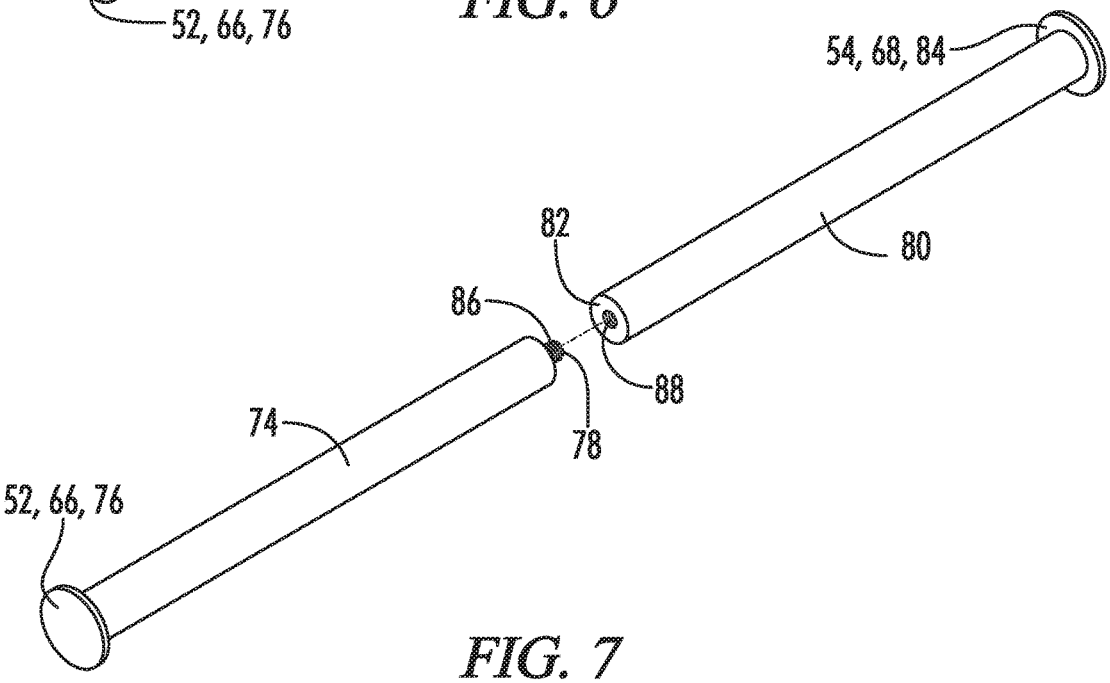
FIG. 7 illustrates a side perspective exploded view of the rod of FIG. 3.
Figure 8:
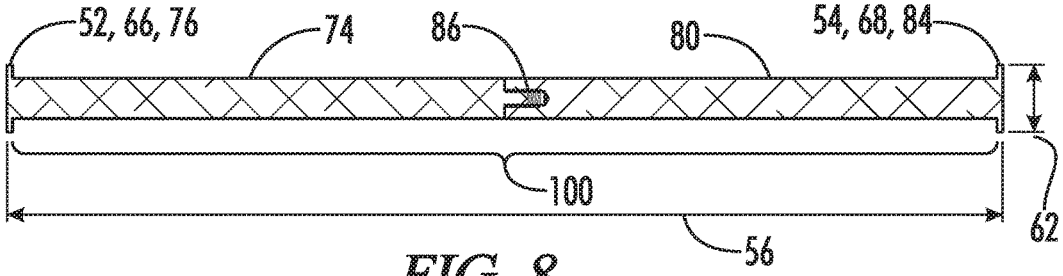
FIG. 8 illustrates a side sectional view of the rod of FIG. 6.

Optionally, as is the case of the embodiment of FIGS. 3-5 but not the embodiment of FIGS. 6-8, the front flange 66 is in the form of a front washer attached to the rod body 100 by a front screw 70 and the rear flange 68 is in the form of a rear washer attached to the rod body 100 by a rear screw 72. Optionally, the combined length of the fully assembled rod 10 and the front screw 70 and the combined length of the fully assembled rod 10 and rear screw 72 are each greater than the distance from the rear end 40 of the front plug 36 to the front end 46 of the rear plug 44, to prevent the front and rear screws 70, 72 from backing out when the rod 10 is located in the oil rail 22. For example, the combined length of the fully assembled rod 10 and the rear screw 72 and the combined length of the fully assembled rod 10 and front screw 70 may each be between about 19 inches and about 22 inches and the distance from the rear end 40 of the front plug 36 to the front end 46 of the rear plug 44 may be less than 19 inches (e.g., 18.9 inches). As used herein, the term "fully assembled" with reference to the rod 10 means that the front screw 70 of present) and rear screw 72 (if present) are fully screwed into the rod body 100 and the rod front section 74 is attached to the rod rear section 80 (if the rod 10 is comprised of a separable front section 74 and rear section 80 as described below).

Optionally, the rod 10 does not fill the entire space in the oil cavity. For example, the distance between the rear end 40 of the front plug 36 and the front end 46 of the rear plug 44 may be greater than the rod length 56 (when the rod 10 is fully assembled), as best seen in FIG. 2 where there is a front gap 90 between the rear end 40 of the front plug 36 and the front end 52 of the rod 10 and a rear gap 92 between the front end 46 of the rear plug 44 and rear end 54 of the rod 10. In addition, the maximum width and maximum height 62 of the rod 10 may be less than the maximum width and maximum height respectively of the oil rail 22. (It will be appreciated that the width and height 62 of the rod 10 may be variable due to the front and rear flanges 66, 68 described above and illustrated in FIGS. 2-8. Similarly, the width and height of the oil rail 22 may be variable due to a step 94, shown in FIG. 2 and known in the art). Optionally, the width and height 62 of the rod body 100 (which excludes the front and rear flanges 66, 68) is at least 10% less than the maximum width and height of the oil rail 22, as shown in FIG. 2. Optionally, the rod length 56 is greater (e.g., at least five or ten fold greater) than the rod width and rod height 62 as shown in FIGS. 2-8. Due to the aforementioned front and rear gaps 90, 92, optionally, the rod 10 (which preferably includes no moving parts) is itself moveable longitudinally within the oil rail 22 between the front end 46 of the rear plug 44 and the rear end 40 of the front plug 36.

Optionally, when fully assembled, the rod length 56 is between about 16 inches and about 20 inches, preferably about 18.75 inches.

Optionally, as shown in FIGS. 2-8, (and previously alluded to with the phrase "when fully assembled"), the rod 10 is comprised of a front section 74 and rear section 80 that removably attach to each other to aid in installation. For example, the rod 10 may be comprised of a front section 74 comprising a front section front end 76 and a front section rear end 78 and a rear section 80 comprising a rear section front end 82 configured to removably attach to the front section rear end 78. During installation, a user may insert both the front section 74 and the rear section 80 through the oil rail front end 34. More particularly, a user may insert the front section front and rear ends 76, 78 and the rear section front end 82 through the oil rail front end 34 with the front section rear end 78 not attached to the rear section front end 82 and then attach the front section rear end 78 to the rear section front end 82 in the oil rail 22. Optionally, as best seen in FIGS. 4, 5, 7, and 8, one of the front section rear end 78 and the rear section front end 82 comprise a connector screw 86 and the other of the front section rear end 78 and the rear section front end 82 comprises a threaded socket 88 configured to receive the connector screw 86. Optionally, the connector screw 86 is a set screw. Optionally, the front section 74, when unattached to the rear section 80, comprises a front section length extending from the front section front end 76 to the front section rear end 78, the rear section 80, when unattached to the front section 74, comprises a rear section length extending from the rear section front end 82 to the rear section rear end 84, and the combined length of the front section 74 and the rear section 80 when the front section 74 is not attached to the rear section 80 is between about 19 inches and about 22 inches, to prevent the connector screw 86 from backing out of the socket 88 in the oil rail 22. (It will be appreciated that the aforementioned combined length includes the length of the connector screw 86). Optionally, the front section 74 comprises a front flange 66 adjacent to the front section front end 76 and the rear section 80 comprises a rear flange 68 adjacent to the rear section rear end 84. Optionally, except for the connector screw 86 and the socket 88, the front section 74 and the rear section 80 are substantially the same size and shape. Optionally, prior to installation of the rod 10 in the oil rail 22, the pump is able to generate a first amount of pressure in the oil rail 22, after installation of the rod 10 in the oil rail 22, the pump is able to generate a second amount of pressure in the oil rail 22, the second amount of pressure greater than the first amount of pressure. Optionally, after installation of the rod 10 in the oil rail 22, the rod 10 takes up at least 75% of the volume of the oil rail 22 between the front plug rear end 40 and the rear plug front end 46. In a preferred embodiment, the rod 10 itself is a solid, non-porous object that does not hold oil, and rather the rod 10 serves as an obstruction to take up space in the oil rail 22 and thereby increase pressure in the oil rail.

It will be appreciated that the rods described herein may be used in a broader application that includes but is not limited to oil rails. For example, in one method, the rod 10 described above is used in a method of increasing pressure within a cavity comprising the steps of; a) providing a pressurized cavity-system comprising a pump and a cavity comprising one or more entrance ports 20 and one or more exit ports 24, the pump configured to pump a fluid through the one or more entrance ports 20 into the cavity and preferably out of the cavity through one or more exit ports 24, the pump configured to generate a first amount of pressure in the cavity; b) providing a rod 10 comprising a rod front end 52, a rod rear end 54, and a rod length 56 extending from the rod front end 52 to the rod rear end 54; and c) positioning the rod 10 in the cavity so that the pump is able to generate a greater amount of pressure in the cavity as compared to step a).

The rod 10 may include one or more features previously described—e.g., the rod 10 may configured to withstand specified heat, the cavity may hold oil or another liquid, the cavity may be in an engine, the rod 10 may include front and rear flanges 66, 68, the rod 10 may be comprised of front and rear sections 74, 80 that removably attach to each other, and the rod 10 may take up at least 75% of the volume of the cavity.

In addition to methods, the present disclosure is also directed to apparatuses such as the rod 10 described. In a preferred embodiment, as described above, the rod 10 includes one or more of the following features: circular front and rear flanges 66, 68, the rod 10 is configured to withstand temperatures of at least 1,080 degrees Fahrenheit, the rod 10 is comprised of a front section 74 comprising a front section front end 76 and a front section rear end 78 and a rear section 80 comprising a rear section front end 82 removably attached to the front section rear end 78, one of the front section rear end 78 and the rear section front end 82 comprise a connector screw 86 and the other of the front section rear end 78 and the rear section front end 82 comprises a threaded socket 88 configured to receive the connector screw 86, the front flange 66 and rear flange 68 have a diameter of between about 1 inch to about 1.5 inches and the rod body 100 has a diameter of about 0.5 inches to about 1 inch, and the rod length 56, when the front section 74 is attached to the rear section 80, is at least about 16 inches. Optionally, as described above the combined length of the front section 74 and the rear section 80 when the front section 74 is not attached to the rear section 80 (which is the same as the fully assembled length plus the length of the connector screw 86) is between about 19 inches and about 22 inches, and the rod length 56, when the front section 74 is attached to the rear section 80, is between about 16 inches and about 19 inches. The rod 10 may include one or more additional features previously described The rod 10 was tested in an oil rail 22 of the FORD POWERSTROKE 7.3L engine (which is the same engine as the International T444E engine) and was shown to be safe and effective. Without being bound by any particular theory, the rod 10 may be used to increase oil pressure within the high pressure oil system to help maintain proper high pressure oil numbers. As a by-product of increasing oil pressure numbers, engine and vehicle performance may be enhanced.

| Part List | |
|---|---|
| Engine | 8 |
| Rod | 10 |
| Oil pressure sensor | 12 |
| High-Pressure Oil Pump | 14 |
| Cylinder Head | 16 |
| High-Pressure Oil Feed Hoses | 18 |
| Entrance port | 20 |
| Common Rail Passage/High-Pressure Oil Rail | 22 |
| Injector Oil Feed Galleries/exit ports | 24 |
| Fuel Injectors | 26 |
| Oil pressure regulator | 28 |
| engine front cover | 30 |
| high-pressure oil pump reservoir | 32 |
| oil rail front end | 34 |
| Front plug | 36 |
| Front plug front end | 38 |
| Front plug rear end | 40 |
| oil rail rear end | 42 |
| Rear plug | 44 |
| Rear plug front end | 46 |
| Rear plug rear end | 48 |
| oil rail length | 50 |
| rod front end | 52 |
| rod rear end | 54 |
| rod length | 56 |
| oil rail maximum height | not labelled |
| oil rail maximum width | not labelled |
| rod maximum height | 62 |
| rod maximum width | not labelled |
| Front flange | 66 |
| Rear flange | 68 |
| Rod body front screw | 70 |
| Rod body rear screw | 72 |
| rod front section | 74 |
| rod front section front end | 76 |

-continued

| Part List | |
|---|---|
| rod front section rear end | 78 |
| rod rear section | 80 |
| rod rear section front end | 82 |
| rod rear section rear end | 84 |
| Connector screw | 86 |
| Threaded socket | 88 |
| Front gap | 90 |
| Rear gap | 92 |
| Step | 94 |
| Plug Threads | 96 |
| Plug O-rings | 98 |
| Rod body | 100 |

Having now described the invention in accordance with the requirements of the patent statutes, those skilled in the art will understand how to make changes and modifications to the disclosed embodiments to meet their specific requirements or conditions. Changes and modifications may be made without departing from the scope and spirit of the invention. It is understood that use of the singular embraces the plural and vice versa. In addition, the steps of any method described herein may be performed in any suitable order and steps may be performed simultaneously if needed.

Terms of degree such as "generally", "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies. In addition, the steps of the methods described herein can be performed in any suitable order, including simultaneously.

What is claimed is:

1. A method of increasing oil pressure within an oil rail of an engine comprising the steps of:

a) providing an engine comprising a pump, a plurality of fuel injectors, and an oil rail, the oil rail comprising i) an oil rail front end, ii) a front plug located adjacent to the oil rail front end and having a front plug front end and a front plug rear end, iii) an oil rail rear end; iv) a rear plug adjacent to the oil rail rear end and having a rear plug front end and a rear plug rear end; v) an oil rail length extending from the oil rail front end to the oil rail rear end; vi) one or more oil rail entrance ports located between the front plug rear end and the rear plug front end; and vii) one or more oil rail exit ports located between the front plug rear end and the rear plug front end, the pump configured to pump oil through the one or more oil rail entrance ports into the oil rail;

b) providing a rod comprising a rod front end, a rod rear end, and a rod length extending from the rod front end to the rod rear end;

c) removing the front plug from the oil rail;

d) inserting the rod through the oil rail front end and into the oil rail so that the rod is located forwardly relative to the front end of the rear plug and the rod length is parallel to the oil rail length; and e) while the rod is located in the oil rail, attaching the same or a different front plug to the oil rail so that, after step e), the rear end of the front plug is located forwardly relative to the rod, wherein, during said attaching of said same or said different front plug to said oil rail, said same or said different front plug is not attached to said rod.

2. The method of claim 1 wherein the rod is generally straight and rigid.

3. The method of claim 1 wherein, after step e), the distance between the rear end of the front plug and the front end of the rear plug is greater than the rod length.

4. The method of claim 3 wherein the rod comprises a maximum rod width generally perpendicular to the rod length and a maximum rod height generally perpendicular to the rod width and rod length, wherein the rod length is at least five times greater than each of the rod maximum height and the rod maximum width.

5. The method of claim 3, wherein, after step d), the rod takes up at least 75% of the volume of the oil rail between the front plug rear end and the rear plug front end.

6. The method of claim 1 wherein the rod comprises a front flange adjacent to the rod front end and a rear flange adjacent to the rod rear end.

7. The method of claim 6 wherein the rod is generally cylindrical in shape, and further wherein the front flange and rear flange are generally circular in shape.

8. The method of claim 7 wherein the front flange and rear flange have a diameter of between about 1 inch and about 1.5 inches and the rod, excluding the front and rear flanges, has a diameter of between about 0.5 inches and about 1 inch.

9. The method of claim 7 wherein the rod comprises a rod body located between the front flange and the rear flange, and further wherein the front flange is in the form of a front washer attached to the rod body by a front screw and the rear flange is in the form of a rear washer attached to the rod body by a rear screw.

10. The method of claim 9 wherein, after step e), the combined length of the rod and the front screw is between about 19 inches and about 22 inches and the combined length of the rod and the rear screw is between about 19 inches and about 22 inches.

11. The method of claim 9 wherein the rod body diameter is less than each of the maximum height and maximum width of the oil rail.

12. The method of claim 1 wherein, after step e), the rod length is between about 16 inches and about 20 inches.

13. The method of claim 1 wherein the rod is configured to withstand temperatures of at least 1,080 degrees Fahrenheit.

14. The method of claim 1 wherein, after step e), the rod is moveable longitudinally within the oil rail between the front end of the rear plug and the rear end of the front plug.

15. The method of claim 1 wherein, at least after step e), the rod is comprised of a front section comprising a front section front end and a front section rear end and a rear section comprising a rear section front end removably attached to the front section rear end.

16. The method of claim 15 wherein step d) comprises inserting both the front section and the rear section through the oil rail front end.

17. The method of claim 15 wherein step d) comprises inserting the front section front and rear ends and the rear section front end through the oil rail front end with the front section rear end not attached to the rear section front end and then attaching the front section rear end to the rear section front end in the oil rail.

18. The method of claim 17 wherein the front section, when unattached to the rear section, comprises a front section length extending from the front section front end to the front section rear end, wherein the rear section, when unattached to the front section, comprises a rear section length extending from the rear section front end to the rear section rear end, and further wherein the combined length of the front section and the rear section when the front section is not attached to the rear section is between about 19 inches and about 22 inches, and further wherein the rod length, when the front section is attached to the rear section is between about 16 inches and about 19 inches.

19. The method of claim 15 wherein one of the front section rear end and the rear section front end comprise a connector screw and the other of the front section rear end and the rear section front end comprises a threaded socket configured to receive the connector screw.

20. The method of claim 19 wherein the front section comprises a front flange adjacent to the front section front end and the rear section comprises a rear flange adjacent to the rear section rear end.

21. The method of claim 19 wherein, except for the connector screw and the socket, the front section and the rear section are substantially the same size and shape.

22. The method of claim 1 wherein, in step a) the pump is able to generate a first amount of pressure in the oil rail, wherein, after step e), the pump is able to generate a second amount of pressure in the oil rail, the second amount of pressure greater than the first amount of pressure.

* * * * *